United States Patent [19]

Ku

[11] Patent Number: 4,853,741

[45] Date of Patent: Aug. 1, 1989

[54] DISPOSABLE WEB CLEANING DEVICE FOR ELECTROSTATOGRAPHIC APPARATUS

[75] Inventor: Wayne W. Ku, Henrietta, N.Y.

[73] Assignee: Eastman Kodak Company, Rochester, N.Y.

[21] Appl. No.: 159,011

[22] Filed: Feb. 23, 1988

[51] Int. Cl.[4] ..... G03G 21/00; A46B 15/00

[52] U.S. Cl. ..... 355/300; 15/256.5

[58] Field of Search ..... 355/15; 118/652; 15/100, 228, 231, 256.5; 360/128

[56] References Cited

U.S. PATENT DOCUMENTS

| | | | |
|---|---|---|---|
| 3,190,198 | 6/1965 | Eichorn | 355/15 |
| 3,641,605 | 2/1972 | Lindsay | 355/15 Y |
| 4,635,154 | 1/1987 | Allsop et al. | 360/128 |

*Primary Examiner*—Arthur T. Grimley
*Assistant Examiner*—J. Pendegrass
*Attorney, Agent, or Firm*—Leonard W. Treash

[57] ABSTRACT

Disposable web cleaning device for backside of endless belt imaging element, includes a housing having an elongated aperture across which a cleaning web is stretched. A film ski guides the web from a supply spindle through the aperture into engagement with the belt and back to a take-up spindle.

12 Claims, 2 Drawing Sheets

DISPOSABLE WEB CLEANING DEVICE FOR ELECTROSTATOGRAPHIC APPARATUS

TECHNICAL FIELD

This invention relates to web cleaning and more particularly to web cleaning in electrostatographic apparatus.

BACKGROUND ART

The primary cleaning station for electrostatographic apparatus commonly is a fur or magnetic brush capable of removing the substantial residual toner left on the image side of an imaging drum or web. Smaller apparatus have used a web cleaner for this purpose. The web is a tissue-like material wound on supply and take-up rolls. A portion in contact with the imaging element cleans the surface of residual toner. The web is indexed periodically or continuously to present a clean surface to the element. A serviceman replaces the web periodically.

An endless belt imaging member attracts airborne and other toner to its backside. Unless exposure is through the base, this is not of major consequence. However, such toner can eventually find its way to the optics, become imbedded in supporting roller surfaces and even affect the electrical balance of the imaging element. If it can be accomplished economically, cleaning of the backside of an imaging element is an opportunity to eliminate misplaced toner and will enhance the performance of the belt and performance of the apparatus.

DISCLOSURE OF THE INVENTION

It is the object of the invention to provide a cleaning device for the backside of an endless belt imaging member that is both effective and economical.

This and other objects are accomplished by a disposable web cleaning device including an elongated housing holding supply and take-up spindles for a disposable cleaning web. An elongated aperture in the housing permits access to the cleaning web. The device is placed over a film ski in the apparatus which forces the cleaning web through the aperture where it contacts and cleans the imaging web while firmly backed by the ski. The take-up spindle includes a coupling permitting it to be driven by the apparatus in which the device is inserted.

Because very limited demands are placed on a backside cleaner, this device can be indexed very slowly. Thus, it need not be replaced more often than the imaging belt itself, for example, every million images. Replacement is a one to two minute task in that environment. The device itself is made of inexpensive materials and has few parts.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
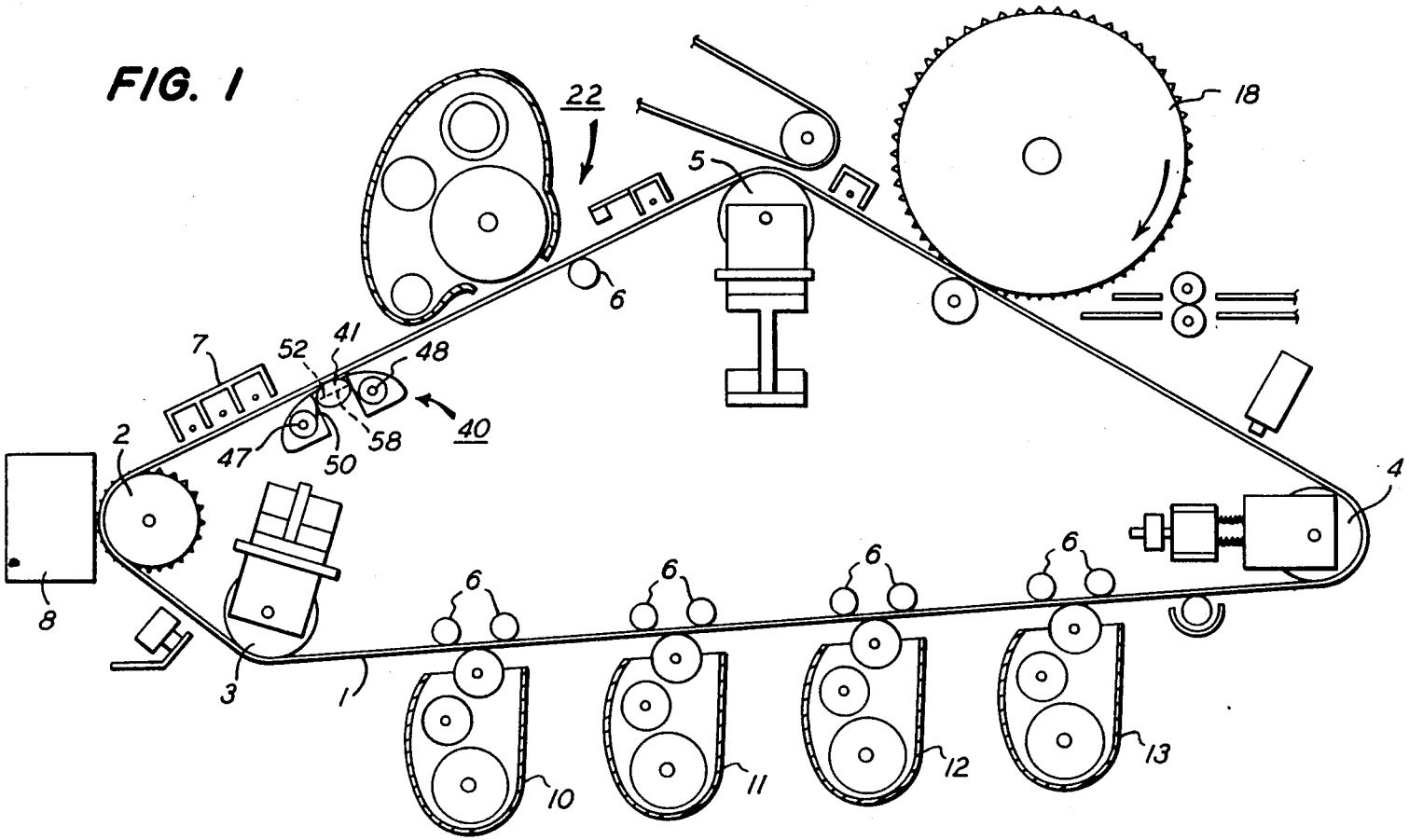
FIG. 1 is a side schematic view of an electrostatographic apparatus using the cleaning device.

According to FIG. 1 the invention is particularly usable in a nonimpact printer having an endless belt 1 entrained about a series of rollers 2, 3, 4 and 5. The path of the belt is also defined in part by film skis 6, which are stationary, nonrotating elements which partially support the belt and against which it slides. The printer has the usual electrophotographic stations including a charging station 7 an electronic exposure station 8, developing stations 10, 11, 12 and 13, a transfer station 18 and a primary cleaning station 22. All of these stations function in the usual manner and need not be further elaborated upon here.

Some toner finds its way to the backside of the belt 1. Long range performance and reliability of the apparatus can be enhanced by cleaning it off before it migrates to more sensitive elements. For that purpose, a backside cleaning device 40 is mounted on a cleaning station ski 41.

Figure 2:
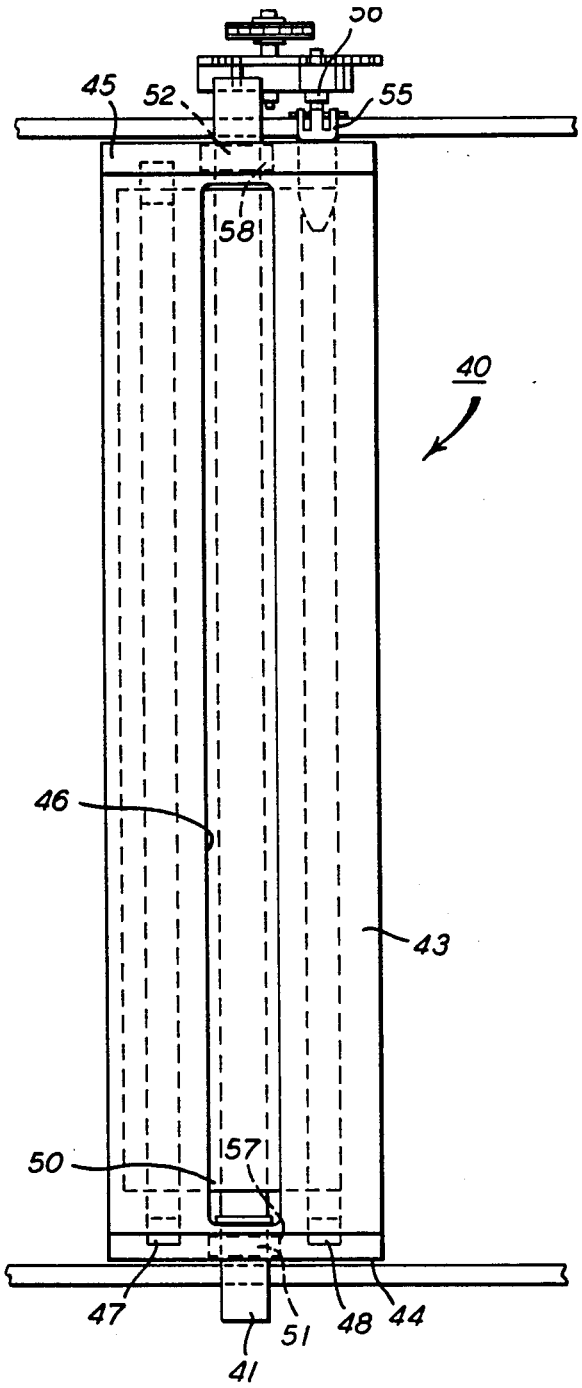
FIG. 2 is a top view of a cleaning device constructed according to the invention.
Figure 3:
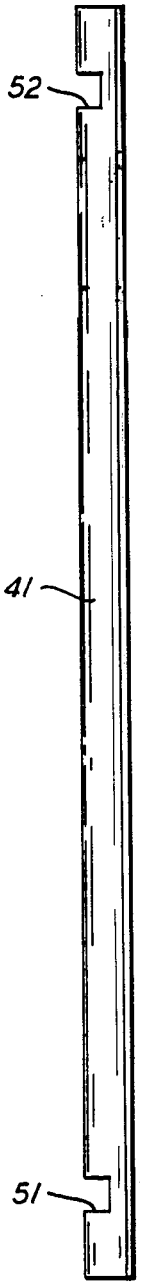
FIG. 3 is a side view of a film ski forming part of the mounting structure for the cleaning device.

According to FIGS. 1 and 2, the backside cleaning device 40 includes an elongated housing 43 including opposed ends 44 and 45 and an elongated aperture 46. Between the ends 44 and 45 are mounted for rotation a supply spindle 47 and a take-up spindle 48 for a cleaning web 50. As shown in FIG. 3, the ski 41 contains notches 51 and 52 which receive the ends 45 and 44, respectively, pushing the cleaning web 50 out of the elongated aperture 46 where it is accessible to the belt 1. To properly position the device 40 with the spindles 47 and 48 below the ski 41, the ends 44 and 45 contain means for receiving the ski, for example, recesses 57 and 58 which mate with notches 51 and 52.

One end of the take-up spindle 48 has a coupling 55 which mates with a drive mechanism 56 which is part of the apparatus. Drive mechanism 56 can be driven by the main drive of the apparatus providing it is appropriately geared down for very slight movement. For example, a gear ratio of 50,000 to one giving a speed of 0.15 revolutions per hour will provide adequate cleaning for the backside of the belt and will conserve cleaning material enough to permit the device to be replaced only on infrequent regular service calls.

In replacement, when the belt 1 is off the machine, the cleaning device 40 is placed with the recesses 57 and 58 of ends 44 and 45 in the notches 51 and 52 of the ski 41 with coupling 55 mating with drive mechanism 56. The cleaning web is forced by the ski out of the elongated aperture 46. When the belt is placed back on the rollers it is lightly supported by ski 41 through the cleaning web 50. As the apparatus is used the web cleans the backside of the belt 1. The cleaning web is gradually indexed by drive mechanism 56 to present a clean surface to the belt.

Note that the only coupling elements are the film ski 41-ends 44 and 45 engagement and the drive engagement between coupling 55 and drive mechanism 56. This contributes to the ease in replacement and simplicity of construction of the device and its receiving apparatus. Although the cleaning device could be reused, its simplicity of construction makes it actually more economical if thrown out when replaced.

The invention has been described in detail with particular reference to a preferred embodiment thereof, but it will be understood that variations and modifications can be effected within the spirit and scope of the invention as described hereinabove and as defined in the appended claims.

I claim:

1. A cleaning device comprising:

an elongated housing having opposing ends and an elongated aperture between the ends, said opposing ends including means for receiving notches in a film ski upon which the device is to be mounted, supply and take-up spindles mounted between the ends, and a cleaning web mounted on the spindles and extending across the aperture.

2. A device according to claim 1 further including a drive coupling associated with said take-up spindle.

3. An electrostatographic apparatus in which an endless belt imaging element moves through operative relation with a series of stations, said belt being entrained about a series of rollers and at least one nonrotatable film ski, wherein said apparatus includes a cleaning device having an elongated housing having opposing ends and an elongated aperture between the ends, supply and take-up spindles mounted between the ends, and a cleaning web mounted on the spindles and extending across the aperture, said cleaning device being mounted between said at least one film ski and said belt, said film ski being so positioned to guide said cleaning web from the supply spindle out of said aperture into cleaning engagement with said belt and back through the aperture to the take-up spindle.

4. Apparatus according to claim 3 including indexing means coupleable with the take-up spindle of the device to gradually present a new cleaning surface to the belt.

5. A disposable cleaning device comprising:

an elongated housing supporting opposing parallel ends with an elongated aperture in the housing extending between the ends, supply and take-up spindles mounted for rotation between the ends, a cleaning web mounted on the spindles and extending across the aperture, a drive coupling associated with the take-up spindle, recesses in the ends extending toward the aperture and positioned to receive notches in opposing ends of a film ski, the center portion of which film ski, when the notches of said film ski are received in said recesses, would force the cleaning web out of the aperture.

6. A cleaning device for insertion into apparatus of the type having an endless belt entrained about a series of rollers and at least one film ski, said device comprising:

an elongated housing having opposing ends and an elongated aperture between the ends, supply and take-up means mounted between the ends, a cleaning web mounted on the supply and take-up means and extending across the aperture, and recesses in said housing to permit engagement by the one film ski of the side of the web opposite the aperture to force the web out of the aperture and into cleaning relation with the belt while said housing is supported by the film ski.

7. A cleaning device according to claim 6 for use with apparatus in which the film ski has opposing ends, said device further comprising means engagable with the ends of the film ski to support the device while the web is in cleaning relation with the belt.

8. A cleaning device according to claim 6 for use with apparatus in which the film ski has notches in opposing ends, said device further comprising means engagable with the notches of the film ski to support the device while the web is in cleaning relation with the belt.

9. A cleaning device according to claim 9 wherein said means engagable with the notches defines a portion of the recesses extending toward the aperture.

10. A cleaning device according to claim 8 wherein said take-up means includes a drive coupling.

11. A cleaning device according to claim 6 wherein said take-up means includes a drive coupling.

12. An electrostatographic apparatus in which an endless belt imaging element moves through operative relation with a series of stations, said belt being entrained about a series of rollers and at least one nonrotatable film ski, wherein said apparatus includes a cleaning device supported by said film ski between said ski and the backside of said belt, said device including a cleaning web held by the film ski against the backside of the belt.

* * * * *